United States Patent [19]

Lelental et al.

[11] 4,155,761

[45] May 22, 1979

[54] ELECTRICALLY ACTIVATED CHARGE SENSITIVE RECORDING MATERIAL AND PROCESS

[75] Inventors: Mark Lelental, Penfield; Henry J. Gysling, Rochester, both of N.Y.

[73] Assignee: Eastman Kodak Company, Rochester, N.Y.

[21] Appl. No.: 918,877

[22] Filed: Jun. 26, 1978

Related U.S. Application Data

[63] Continuation-in-part of Ser. No. 783,577, Apr. 1, 1977, abandoned.

[51] Int. Cl.[2] ..... G03G 5/026; G03G 5/04

[52] U.S. Cl. ..... 96/1.5; 96/68

[58] Field of Search ..... 96/1 R, 1.5, 1 E, 48 PD; 204/2, 18 PC

[56] References Cited

U.S. PATENT DOCUMENTS

| | | | |
|---|---|---|---|
| 3,700,448 | 10/1972 | Hillson et al. | 96/48 PD |
| 3,829,317 | 8/1974 | Case | 96/48 PD |
| 3,893,854 | 7/1975 | Honjo et al. | 96/48 PD |
| 4,113,484 | 9/1978 | Lelental et al. | 96/48 PD |

*Primary Examiner*—Roland E. Martin, Jr.
*Assistant Examiner*—John L. Goodrow
*Attorney, Agent, or Firm*—Richard E. Knapp

[57] ABSTRACT

A non-silver, charge-sensitive recording composite element having an ohmic resistivity of at least about $1\times10^{10}$ ohm-cm comprising (a) a first electrically conducting layer in association with (b) a photoconductor layer, (c) a non-silver, electrically activated recording layer comprising an image-forming combination of (i) a certain tellurium (II) coordination complex with (ii) a reducing agent, and a binder and (d) a second electrical conducting layer can provide a non-silver image having a density equal to silver images. Silica, especially colloidal silica, is also very useful in the recording layer. The recording element can be room light handleable and can provide a developed image by dry development processes.

15 Claims, 4 Drawing Figures

LATENT IMAGE FORMATION

HEAT DEVELOPMENT

LATENT IMAGE FORMATION

HEAT DEVELOPMENT

ELECTRICALLY ACTIVATED CHARGE SENSITIVE RECORDING MATERIAL AND PROCESS

This is a first continuation-in-part application of Ser. No. 783,577 of Mark Lelental and Henry J. Gysling, filed Apr. 1, 1977, now abandoned.

BACKGROUND OF THE INVENTION

This invention relates to non-silver, charge-sensitive recording materials having certain ohmic resistivity. One aspect of the invention relates to the use of a non-silver, electrically activated recording layer comprising a certain image-forming combination of a certain tellurium (II) coordination complex with a reducing agent in a non-silver, charge-sensitive recording composite material having certain ohmic resistivity to provide a developable latent image.

DESCRIPTION OF THE STATE OF THE ART

A variety of recording materials and processes have been developed to provide image recording. The better known and commercially more successful of these recording materials and processes can be classified as being photographic, thermographic or electrographic or as being a combination of two or more of these techniques. For example, one recording material which is known is a photothermographic material which is a heat developable photosensitive material designed for imaging by what is described as dry processing with heat. Each of the known image recording materials and processes has certain advantages for particular uses; but, the materials and processes also suffer from disadvantages which limit the usefulness in other applications. For example, conventional photographic materials have the disadvantage that they are not room light handleable prior to imagewise exposure and processing. Thermographic materials require imagewise heating to provide a visible image and are not capable of the degree of light sensitivity provided by conventional photographic materials. Electrographic materials including, for example, xerographic materials require a mechanical dust pattern transfer procedure in order to provide a desired image.

It has been desirable to provide an image-recording material and process which enables the image density of a developed silver image; but which avoids the expense of conventional photosensitive silver halide materials while at the same time (1) avoiding the need for conventional processing baths and solutions and (2) enabling room light handling of the imaging material prior to imagewise exposure.

Heat developable photographic materials which after imagewise exposure can be heated to provide a developed image in the absence of processing solutions or baths are known. Typical heat developable photosensitive materials or photothermographic materials are described, for example, in U.S. Pat. Nos. 3,152,904 of Sorensen et al, issued Oct. 13, 1964; 3,457,075 of Morgan et al, issued July 22, 1969; 3,152,903 of Shepard et al, issued Oct. 13, 1964; 3,392,020 of Yutzy et al, issued July 9, 1968; British Specification No. 1,161,777 published Aug. 20, 1969 and U.S. Pat. No. 3,801,321 of Evans et al, issued Apr. 2, 1974. These photosensitive materials have the disadvantage that they are not room light handleable prior to imagewise exposure for recording purposes.

It has been desirable to provide a non-silver material for heat developable image recording. Attempts have been made in the past to provide a reduced silver concentration in heat developable photosensitive materials. For example, U.S. Pat. No. 3,152,903 of Shepard et al, issued Oct. 13, 1964 provides what is described as a dry processable imaging material containing a non-silver component. It is indicated that the image-forming combination can comprise a latent irreversible oxidation-reduction reaction composition which is capable of initiation by electron transfer from a non-silver photocatalyst. The photocatalyst can be, for example, zinc oxide or titanium dioxide. A disadvantage of this imaging material is that the image formation is carried out using an image-forming combination that is not capable of amplification as in most heat developable silver photographic materials. This provides the necessity for undesirably high concentrations of non-silver materials in the image-recording element. It has been desirable to overcome this problem by providing a more effective non-silver heat developable material which avoids the need for a photosensitive component and which enables desired latent image amplification.

An amplification step is an important factor in increased speed image-recording materials. In such materials, and processes for their use, a catalyst is generally formed by imagewise exposure of a photosensitive material. The resulting invisible or latent image formed is then used to catalyze the reduction of a material in a high oxidation state to a visible image in a low oxidation state. For example, in silver halide photographic materials exposure of photographic silver halide to light results in formation of silver nuclei which then catalyze the further reduction of silver halide to silver in the presence of a reducing agent.

One of the means proposed for imaging uses certain recording materials which involve passing an electric current through the recording materials. These materials involve electrographic image-recording techniques such as described by K. S. Lion et al in a report entitled "Investigation in the Field of Image Intensification, Final Report," in Air Force Cambridge Research Laboratories AFCRL 64-133, Jan. 31, 1964, Contract No. AF19(605)-5704 which describes an electrographic process in which the recording element comprises a conventional light sensitive photographic material that is positioned adjacent to a photoconductive layer for image recording purposes. Upon applying a uniform electric field across the described photoconductive and photographic layers and simultaneously imagewise exposing the photoconductive layer to a light pattern, an imagewise current is produced in the photographic layer according to the description. This imagewise current flow in turn is indicated as producing a chemically developable latent image in the photographic layer. The image is described as being more intense for a given light exposure than an image produced by imagewise exposing the photographic layer directly. While the described recording material and process appear to provide the advantage of increased sensitivity, it also provides a disadvantage associated with use of a light sensitive, developable recording layer which requires processing with conventional solutions and baths. Moreover, the production of a latent image in such a conventional light sensitive silver halide photographic material requires a substantial current flow in the emulsion and therefore provides a relatively lengthy exposure time with low current flow or a high current flow with a short exposure time. Moreover, the light sensitive material does not enable room light handling prior to imagewise exposure and also provides the disadvantage of increased cost of silver halide as the photosensitive component.

Another approach to imaging is described in U.S. Pat. No. 3,138,547 of Clark, issued June 23, 1964. This approach involves the use of a light insensitive, electrosensitive recording layer containing particles of a reducible metal compound capable of electrical reduction in situ. The recording layer is positioned on an electrically conductive backing and recording is provided by contacting the layer with an electrically charged stylus. Current is caused to flow through the recording layer to reduce the particulate metal compound, in the dry state, to provide a visible image. A drawback of this recording material and process is that it involves no gain or amplification step. For each reduction leading to an increase in density of the final image, an additional quantity of electronic charge flowing through the recording element must be provided. This causes the need for an undesirably high current density in order to produce a visible image within a reasonable period of time.

Another recording material and process is described in U.S. Pat. Nos. 2,798,959 and 2,798,960 issued July 9, 1957 to Moncrieff-Yeates. The imaging material described involves a photoconductive material and a heat-sensitive material interposed between and in electrical contact with a pair of electrodes. An optical image is projected on the photoconductive material while a voltage is applied across the electrodes. The flow of electric current heats the photoconductive material, the heating effect in each increment of area being a function of the amount of current flowing, the resistivity of the photoconductive material and the intensity of the imagewise illumination. The heat image thus produced in the photoconductive material changes the heat sensitive material to form a permanent image. A disadvantage of the recording material and process in these patents is that a high current flow is required in the photoconductive material in order to produce sufficient quantities of thermal energy for image formation. This recording material and process, as in the process described by Clark, requires an incremental increase in current flow for each incremental increase in density of the final image. It does not involve an amplification which is required for higher speed imaging.

Another image-recording material and process which provides a type of gain is described in U.S. Pat. No. 3,425,916 of Takemoto et al, issued Feb. 4, 1969. According to this process, chemically developable nuclei are formed in what is described as a reagent layer by imagewise exposing the layer to a certain concentration of electric current. Unlike direct printout image recording processes, the current flow itself need not be sufficient to produce a visible reaction in the reagent layer. Rather, the current flow according to this patent need only be sufficient to produce nuclei which are chemically developable to provide a visible image. While this process requires relatively low current flow to produce a developable latent image, the process does require that the recording material be moistened during the latent image or nuclei forming step. Moreover, the recording material on which the nuclei forming process is carried out requires a processing bath or solution for development to intensify and render the latent image visible. Moreover, the image must be stabilized by washing and fixing as in conventional photographic silver halide processes.

A further electrographic image recording process which incorporates a type of image amplification is described in British Specification No. 1,275,929 published June 1, 1972. In this process a latent image is formed by applying an imagewise electric current to a conductive recording sheet formed of a conductive powder and an image-forming component in a binder. The recording sheet is subsequently heated in the presence of a redox combination which includes a compound having at least one metal selected from nickel, cobalt, zinc, chromium, tin and copper to produce a visible image with the image-forming component. A disadvantage of this process is that it requires relatively large current flow, that is equal to or larger than one milliampere per square centimeter, through the conductive recording sheet for short times. Consequently, the production of relatively high charge density levels, that is equal to or greater than one millicoulomb per square centimeter, are required for suitable latent image formation. In certain electrographic image recording materials, the use of a conductive recording material and/or the production therein of a charge density of 1 millicouloumb/cm$^2$ or greater is either impossible or undesirable within a practical imagewise exposure period. An example is the use of electrosensitive recording materials with sources of activating electrical energy, such as corona discharge devices or electrostatic charge devices that do not develop a high electron current and cannot therefore produce a high charge density level in a reasonably short exposure period. Another example is the use of electrosensitive recording materials to detect electromagnetic radiation by sandwiching the recording material with an electrophotographic photoconductor. To produce an imagewise current flow through the recording material, the resistivities of the photoconductor and the recording element must be reasonably matched within a predetermined range. Existing electrophotographic photoconductors are high impedance, low current devices. Therefore, if the recording material is highly conductive relative to the photoconductor, no latent image can be formed.

Each of the described imaging materials and processes lacks one or more of the advantages as follows: (a) a non-silver imaging material and process, (b) a room light handleable imaging material and process, (c) a charge-sensitive imaging material and process which enables an ohmic resistivity which is within a desirable range, (d) a non-silver imaging material and process that enables developed image densities which are equal to or higher than those densities provided by conventional silver halide photographic materials, (e) a non-silver imaging material and process that enables the use of fewer components in the imaging material to provide a developed black tone image and (f) a non-silver imaging material and process that enables latent image amplification and avoids the need for processing solutions or baths.

A particular need has continued for a non-silver imaging material which is room light handleable and suitable for radiography, such as medical radiography. In this use it is important that as little X-ray radiation as possible be used for imaging. The recording material therefore must be capable of forming a latent image with a significantly low charge density upon brief X-ray exposure. The conventional silver halide photographic materials used for medical radiography have involved a high degree of photosensitivity but have the disadvantage of not being room light handleable. Conventional commercial X-ray sensitive silver halide photographic materials also have been processed in processing solutions or baths and have not been dry processable.

A variety of tellurium compounds or complexes are known in materials for imaging, such as described in Belgian Pat. No. 820,220 published Jan. 16, 1975; Belgian Pat. No. 786,235 issued July 31, 1972; U.S. Pat. No. 3,700,448 of Hillson, issued Oct. 24, 1972; and *Research Disclosure,* Volume 166, February 1978, Item No. 16656 and Item No. 16655 of M. Lelental and H. J. Gysling. None of these provide a suitable answer to the combinations of problems described. There has also been a continuing need to provide improved tellurium containing heat developable imaging materials and processes which enable elimination of silver in the image-recording material. This continuing need has been especially true for non-silver, heat developable materials which enable amplification of a nuclei image. It has been found that certain tellurium complexes do not provide an image in certain electrically activated recording materials. Prior art Te(IV) coordination complexes and organometallic derivatives containing Te(IV) are not suitable in electrically activated recording materials. For example, tellurium dichloride bisacetophenone compounds $$[TeCl_2(CH_2\overset{\overset{O}{\|}}{C}Ar)_2,$$

where Ar is phenyl or substituted phenyl such as o-$CH_3OC_6H_4$- or p-$CH_3C_6H_4$, etc.] are not effective for this purpose.

Further, while dry electrographic recording materials and processes which involve production of a visible image in a charge-sensitive recording element have been described in French Pat. No. 2,280,517 published Feb. 27, 1976, no answer to the combined problems, especially a desired non-silver imaging material in such a process is described.

SUMMARY OF THE INVENTION

It has been found according to the invention that the described combination of advantages are provided by a non-silver, charge-sensitive recording composite element having an ohmic resistivity of at least about $1\times10^{10}$ ohm-cm comprising, in sequence, a support having thereon (a) a first electrical conducting layer, (b) a photoconductor layer, (c) a non-silver, electrically activated recording layer comprising an image-forming combination of (i) a tellurium (II) coordination complex as described herein, with (ii) a reducing agent, and a binder, and (d) a second electrical conducting layer. Silica, especially colloidal silica, is also very useful in the recording layer. Silica helps produce increased developed image density in the recording layer. An image is formed in the described composite element by imagewise exposing the photoconductor layer to suitable energy and simultaneously applying an electric potential across the described photoconductor and recording layers which causes formation of a developable latent image in the non-silver, electrically activated recording layer. This latent image can then be developed by uniformly heating the layer containing the latent image at a temperature and for a time sufficient to develop the image.

The disadvantages, as described, are accordingly overcome by providing an electrographic recording process and material which enables formation of a latent image in a certain resistive, charge-sensitive, dry processable recording layer containing the described tellurium (II) coordination complex with a reducing agent, by passing a relatively minute concentration of electrical charge through the layer in an imagewise pattern and then amplifying the resulting latent image by uniformly heating the recording element.

Due to the fact that the tellurium image-forming combination does not require commonly employed toners or post-processing stabilizers, the image-recording material is surprisingly lower in cost due to the reduced number of components formerly thought required to provide a black-tone image.

It has also been found according to the invention that a developed tellurium image can be provided in a dry electrically activated recording process in a charge-sensitive recording element having an ohmic resistivity of at least about $1\times10^{10}$ ohm-cm and containing at least one electrically activated recording image-forming combination of (i) a tellurium (II) coordination complex as described herein, with (ii) a reducing agent also as described comprising the steps of: (a) applying an electric potential imagewise to the described recording element of a magnitude and for a time sufficient to produce in the image areas a charge density within the range of about 1 microcouloumb per square centimeter to about 1 millicouloumb per square centimeter, wherein the charge density is sufficient to form a developable latent image in the recording element; and (b) heating the recording element substantially uniformly at a temperature and for a time sufficient to develop the latent image. Because the charge exposure necessary for latent image formation is several orders of magnitude less than that required by previously described dry, non-silver electrographic image recording processes, lower levels of charge density can be recorded according to the invention.

Another embodiment of the invention is a dry, non-silver electrically activated recording process for producing a developed tellurium image in a charge-sensitive recording composite element having an ohmic resistivity of at least about $1\times10^{10}$ ohms-cm comprising, in sequence, a support having thereon (a) a first electrical conducting layer, (b) a photoconductor layer, (c) an electrically activated recording layer comprising an image-forming combination of (i) a tellurium (II) coordination complex as described herein, with (ii) a reducing agent also as described and a binder, and (d) a second electrical conducting layer, comprising (A) imagewise altering the conductivity of the photoconductor layer in accord with an image (I) to be recorded, and (B) simultaneously applying an electric potential across the described photoconductive and recording layers of a magnitude and for time sufficient to produce a developable latent image in the recording layer corresponding to the image (I); and (C) heating the resulting recording layers substantially uniformly at a temperature and for a time sufficient to develop the latent image. The heating step can be carried out at a temperature within the range of about 80° C. to about 200° C., typically at a temperature within the range of about 100° C. to about 180° C., until the latent image is developed. Other dry, electrically activated recording processes embodying this concept and use of the described image-forming combination comprising the described tellurium (II) complex with a reducing agent can be useful as described herein. For example, the process can include formation of an image using modulation of a corona ion current flow to the recording element with an electrostatic field established imagewise between (1) an image grid comprising an electroconductive core sequentially connectable to sources of different potential relative to the recording material and covered with a coating of a photoconductive insulated material and (2) a control grid that is electrically conductive and sequentially connectable to sources of different potential relative to the recording element.

DETAILED DESCRIPTION OF THE INVENTION

Figure 1:
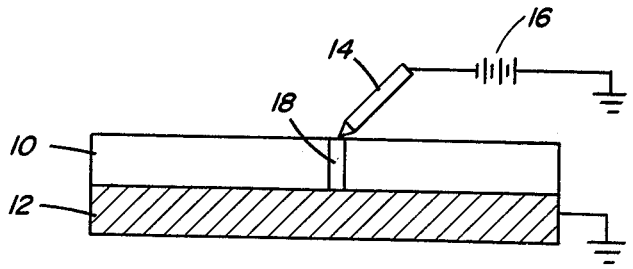
FIGS. 1 and 2 illustrate schematically an image-recording material and process according to one illustrative embodiment of the invention.

A variety of materials are useful in the described non-silver, electrically activated recording material according to the invention. The exact mechanism by which the latent image is formed in the recording material is not fully understood. It is postulated that the injection of an electron due to the electric field into the reducible tellurium ion source results in the formation of the described developable latent image. It is believed that development of the latent image is accomplished by a reaction in the recording material whereby metal from the tellurium ion source, that is the tellurium (II) complex, is provided on the latent image site by a physical development mechanism involving the reaction between the described reducing agent and the tellurium (II) complex. It is not entirely clear, however, why the covering power provided by such a combination is as high or higher than the covering power provided from a similar composition with a silver ion source.

While a variety of image-recording combinations containing tellurium (II) complexes are useful as described according to the invention, the optimum image-recording combination and image-recording element will depend upon such factors as the desired image, the particular image-forming combination, the source of activating electrical energy, processing condition ranges and the like.

The term "charge-sensitive recording material" as used herein is intended to mean a material which when subjected to an electrical current undergoes a chemical and/or electrical change which provides a developable latent image.

The term "latent image" as used herein is intended to mean an invisible or faintly visible image that is capable of amplification in a subsequent processing step, especially in a subsequent heat development step.

The term "resistive recording material" as used herein is intended to mean a material that has an ohmic resistivity of at least about $1\times10^{10}$ ohm-cm.

The described material and process of the invention are versatile as well as simple for image recording. For instance, a variety of devices or means are useful to regulate the current flow through the recording material including, for example, an electrostatically charged stencil, stylus or screen, or a suitable photoconductive layer adjacent the image-forming layer of the charge-sensitive material. Moreover, any source of radiation to which the photoconductor is responsive can be used as the exposure source, provided that the dynamic resistance of the photoconductor closely matches the dynamic resistance of the recording material in the operating voltage range as described for the invention.

The term "complex" as used herein is intended to include any type of bonding or complexing that enables the resulting described tellurium (II) complex to provide oxidizing agent properties in the described image-forming combination. In some instances, the exact bonding of the described tellurium (II) complex is not fully understood. The term "complex" is intended to include complexes and salts, as well as useful Te(II) materials having other forms of bonding, to enable the desired image-forming combination to provide a latent image as well as image amplification as described. The term "complex" also is intended to include neutral complexes or salts of non-neutral complexes.

A variety of tellurium (II) complexes are useful in an image-recording material according to the invention. Useful tellurium (II) complexes are represented by the formula: YTeY′ wherein Y and Y′ are independently bidentate, sulfur containing, univalent anions represented by the formula:

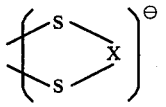

wherein X represents the atoms necessary to complete a dithiocarbamate, xanthate, thioxanthate, dithioacid, dithiophosphinate, difluorodithiophosphinate, dithiophosphate or dithiocarbimate radical. The described radicals are intended to include both those that are unsubstituted and those which are substituted with groups which do not adversely affect the desired image-recording properties of the described complex. Examples of substituent groups of this type include alkyl containing from 1 to 20 carbon atoms, such as $CH_3$, $C_2H_5$ and i-$C_3H_7$.

Useful dithiocarbamate radicals within the described complexes include, for example, those represented by the formula:

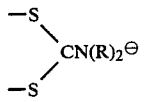

wherein R is alkyl containing 1 to 10 carbon atoms, preferably 1 to 5 carbon atoms, or aryl containing 6 to 12 carbon atoms, such as phenyl and naphthyl. Examples of useful dithiocarbamate radicals include N,N-dimethyldithiocarbamate; N,N-diethyldithiocarbamate; N,N-di-isopropyldithiocarbamate; N,N-dibutyldithiocarbamate; and N,N-dipentyldithiocarbamate.

Useful xanthate radicals within the described complex are represented by the formula:

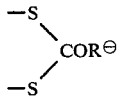

wherein R represents alkyl containing 1 to 20 carbon atoms, preferably 1 to 5 carbon atoms, such as methyl, ethyl, propyl, butyl and pentyl, or aryl containing 6 to 12 carbon atoms, such as phenyl or naphthyl. Examples of useful xanthate radicals include methylxanthate, ethylxanthate, isopropylxanthate, butylxanthate and phenylxanthate.

Useful thioxanthate radicals within the described complex are represented by the formula

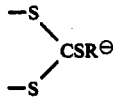

wherein R is as described. Examples of useful thioxanthate radicals include methylthioxanthate; ethylthioxanthate, propylthioxanthate and phenylthioxanthate.

Useful dithioacid radicals within the described complex are represented by the formula:

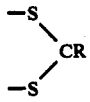

wherein R is as described. Examples of useful dithioacid radicals include dithioacetate, dithiopropionate, dithiobutyrate and dithiobenzoate.

Useful dithiophosphinate radicals within the described complex include those represented by the formula:

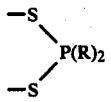

wherein R is as described. Examples of these radicals include dimethyldithiophosphinate, dipropyldithiophosphinate and diphenyldithiophosphinate.

Useful difluorodithiophosphinate radical is represented by the formula: $S_2PF_2$.

Useful dithiophosphate radicals within the described complex are represented by the formula:

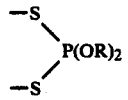

wherein R is as described. Examples of useful dithiophosphate radicals include dimethyldithiophosphate, diethyldithiophosphate, dipentyldithiodiphosphate and diphenyldithiophosphate.

A dithiocarbimate radical which is useful as part of the described complex is represented by the formula:

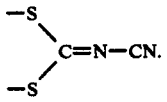

R in the described radicals can represent alkyl or aryl which is substituted or unsubstituted. In each instance the substituents that are useful are those which do not adversely affect the desired image-recording properties of the charge sensitive material. Examples of useful substituents include $CH_3$, $C_2H_5$, i-$C_3H_7$ and $C_6H_5$.

An especially useful embodiment of the invention is a non-silver, charge-sensitive recording composite element, as described, wherein the tellurium (II) coordination complex is represented by the formula:

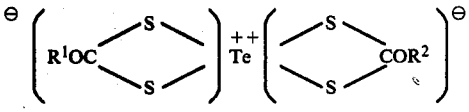

wherein $R^1$ and $R^2$ are individually alkyl containing 1 to 10 carbon atoms, such as methyl, ethyl, propyl, isopropyl, butyl, pentyl and decyl, or aryl containing 6 to 12 carbon atoms such as phenyl and naphthyl.

A range of concentration of tellurium (II) coordination complex is useful in the described non-silver charge-sensitive recording composite element according to the invention. The optimum concentration will depend upon such factors as the particular complex, the particular recording composite element, processing conditions, desired image, and the like. Typically, a concentration within the range of about $10^{-5}$ to $10^{-2}$ moles of tellurium (II) coordination complex per square meter is employed in the described recording composite element according to the invention, preferably a concentration within the range of $2\times10^{-3}$ to $2\times10^{-2}$ moles of tellurium (II) coordination complex per square meter. A typical concentration of described tellurium (II) coordination complex is equivalent to about $8\times10^2$ to about $8\times10^3$ milligrams per square meter of support.

The described non-silver, charge-sensitive recording composite element according to the invention can comprise a variety of reducing agents. These reducing agents can be organic reducing agents or inorganic reducing agents or combinations of reducing agents. Reducing agents which are especially useful are typically silver halide developing agents. Examples of useful reducing agents include polyhydroxybenzenes, such as hydroquinone, alkyl-substituted hydroquinones, including tertiary-butylhydroquinone, methylhydroquinone, 2,5-dimethylhydroquinone and 2,6-dimethylhydroquinone; catechols and pyrogallols; chloro-substituted hydroquinones such as chlorohydroquinone or dichlorohydroquinone; alkoxy-substituted hydroquinones such as methoxyhydroquinone or ethoxyhydroquinone; aminophenol reducing agents such as 2,4-diaminophenols and methylaminophenols; ascorbic acid reducing agents such as ascorbic acid, ascorbic acid ketals and ascorbic acid derivatives; hydroxylamine reducing agents; 3-pyrazolidone reducing agents such as 1-phenyl-3-pyrazolidone and 4-methyl-4-hydroxymethyl-1-phenyl-3-pyrazolidone; reductone reducing agents such as 2-hydroxy-5-methyl-3-piperidino-2-cyclopentanone; sulfonamidophenol reducing agents such as the sulfonamidophenol reducing agents described in *Research Disclosure,* January 1973, pages 16–21 published by Industrial Opportunities Ltd., Homewell, Havant Hampshire, PO9 1EF, UK; and the like. Combinations of reducing agents can be useful. Selection of an optimum reducing agent or reducing agent combination will depend upon such factors as processing conditions, desired image, other components of the composite element and the like.

An especially useful embodiment of the invention is a non-silver, charge-sensitive recording composite element as described wherein the reducing agent is selected from the group consisting of 3-pyrazolidone, phenolic, reductone and sulfonamidophenol reducing agents and combinations thereof as described. Typical reducing agents which are useful according to the invention are para-benzenesulfonamidophenol and 2,6-dichlorobenzenesulfonamidophenol.

It is important that the reducing agent or reducing agent combination selected not adversely affect and not be adversely affected by the charge sensitivity and ohmic resistivity of the described element according to the invention.

A range of concentration of reducing agent or reducing agent combination is useful in the described element according to the invention. The optimum concentrations will depend upon such factors as the particular recording composite, the particular reducing agent or reducing agent combination, processing conditions, desired image, and the like. Typically, a concentration of about $10^{-2}$ to about 10 moles of reducing agent per mole of the described tellurium (II) coordination complex is employed in the element according to the invention, preferably a concentration within the range of about $10^{-1}$ to about 1 mole of reducing agent per mole of the described tellurium (II) coordination complex. The described concentration corresponds to about $10^2$ to about $10^4$ milligrams of the described reducing agent per square meter of support.

When reducing agent according to the invention are employed in combination, the total concentration of reducing agent is typically within the described concentration range.

Silica is useful in the image-recording layer of a non-silver, charge-sensitive recording element according to the invention. Silica in the recording layer helps produce increased density in a developed image upon imagewise exposure and heating the recording layer. A variety of forms of silica is useful. However, colloidal silica is especially useful because it has a large surface area. The optimum concentration of silica in the recording layer will depend upon such factors as the desired image, other components in the recording layer, processing conditions and layer thickness. Typically, the concentration of silica is within the range of about 2 to about 2000 mg/ft$^2$ (corresponding to 2 to about 2000 mg/929 cm$^2$) of support, such as within the range of about 5 to about 1000 mg/ft$^2$.

The average particle size and particle size range of silica in the recording layer can vary. The optimum average particle size and particle size range of silica will depend upon the described factors regarding silica concentration. Typically the average particle size and particle size range of colloidal silica is most useful. Collodial silica that is useful includes such commercially available colloidal silica products as "Cab-O-Sil", a trademark of and available from the Cabot Corp., U.S.A. and "Aerosil", a trademark of and available from DEGUSSA, W. Germany. It is important that the average particle size and particle size range of the silica or any other equivalent particles not adversely affect the desired properties of the electrically activated recording element of the invention or the desired image produced upon imagewise exposure and heating of the recording layer. For instance, the silica selected should not decrease sensitivity of the recording layer or produce undesired fogging of the developed image.

The mechanism and properties which cause colloidal silica to produce increased density of an image in a recording layer according to the invention is not fully understood. It is believed that the large surface area of colloidal silica contributes to the desired results. In any case, an especially useful embodiment of the invention, as described, is one containing colloidal silica in the recording layer of a charge-sensitive recording element.

While it is often not necessary or desirable in an element according to the invention, a photosensitive component can also be present in the element as described. This photosensitive component can be any photosensitive metal salt or complex which provides developable nuclei upon charge exposure according to the invention. The term "photosensitive" is intended to include photographic also. If a photosensitive component is employed, an especially useful photosensitive metal salt is photosensitive silver halide due to its high degree of light sensitivity. A typical concentration of photosensitive metal salt is within the range of about 0.0001 to about 10.0 moles of photosensitive metal salt per mole of described tellurium (II) coordination complex in the described element according to the invention. For example, a typically useful concentration range of photosensitive silver halide, when such a photosensitive component is employed, is within the range of about 0.001 to about 2.0 moles of silver halide per mole of described tellurium (II) coordination complex. Other photosensitive materials can be useful in the described element according to the invention. For example, a photosensitive silver material can include a silver dye complex such as one of those described in U.S. Pat. No. 3,647,439 of Bass, issued Mar. 7, 1972. When a photosensitive silver halide is employed, a preferred photosensitive silver halide is silver chloride, silver bromide, silver bromoiodide, silver chlorobromoiodide or mixtures thereof. For purposes of the invention, silver iodide is also considered to be a photosensitive silver halide. Very fine-grain photographic silver halide is especially useful, although coarse or fine-grain photographic silver halide can be employed if desired. The photographic silver halide can be prepared by any of the procedures known in the photographic art. Such procedures and forms of photographic silver halide are described, for example, in the *Product Licensing Index*, Volume 92, December 1971, publication 9232 on page 107, paragraph I published by Industrial Opportunities, Ltd., Homewell, Havant Hampshire, PO9 1EF, UK. The photograhic silver halide can be washed or unwashed, can be chemically sensitized using chemical sensitization procedures known in the art, can be protected against the production of fog and stabilized against loss of sensitivity during keeping as described in the above *Product Licensing Index* publication.

If a photosensitive component is employed in the described element according to the invention, the described image-forming combination enable the concentration of photosensitive metal salt to be lower than normally would be expected in a photosensitive element. This lower concentration is enabled by the amplification effect of the image-forming combination, as described, as well as the formation of developable nuclei according to the invention. In some instances of the concentration of photosensitive metal salt can be sufficiently low that after imagewise exposure and development of the photosensitive metal salt alone, in the absence of other of the described components, the developed image is not visible.

The non-silver, charge-sensitive recording composite element according to the invention can also comprise one or more other oxidizing agents than the described tellurium (II) coordination complex, if desired. For example, the composite element as described can contain a silver salt oxidizing agent such as a silver salt of a long-chain fatty acid. Such silver salt oxidizing agents are typically resistant to darkening upon illumination. Typically useful silver salts of long-chain fatty acids are those containing about 17 to 30 carbon atoms. Compounds which are useful silver salt oxidizing agents include, for example, silver behenate, silver stearate, silver oleate, silver laurate, silver hydroxystearate, silver caprate, silver myristate, and silver palmitate. Silver salts which are not silver salts of long-chain fatty acids can be useful in combination with the described tellurium complexes also. Such silver salt oxidizing agents include, for example, silver benzotriazole, silver benzoate, silver terephthalate, and the like. Examples of other oxidizing agents that are not silver oxidizing agents that can be useful in combination with the described tellurium (II) coordination complexes are gold stearate, mercury behenate, gold behenate and the like. Combinations of the described oxidizing agents can also be useful. The term "non-silver" as employed herein is intended to include concentrations of the described silver salt oxidizing agents which do not adversely affect image formation in the described element according to the invention.

While it is in most cases not necessary and in some cases not desirable, a stabilizer or a stabilizer precursor for post-processing stabilization of the developed image in the described element according to the invention can be used to aid in post-processing image stability. In some cases the tellurium complex and developed image itself are sufficiently stable after processing so that the use of a stabilizer or stabilizer precursor can be avoided. However, in the case of materials which contain photosensitive silver halide, it can be desirable to include such a stabilizer or stabilizer precursor to help avoid post-processing printout. A variety of stabilizer or stabilizer precursors can be useful in the elements according to the invention. These stabilizers or stabilizer precursors can be used alone or in combination if desired. Typical useful stabilizers or stabilizer precursors include, for instance, photolytically activated polybrominated organic compounds such as described in U.S. Pat. No. 3,874,946 of Costa et al, issued Apr. 1, 1975 and azolethioethers and blocked azolinethione stabilizer precursors such as described in Belgian Pat. No. 768,071 issued July 30, 1971 and 4-aryl-1-carbamyl-2-tetrazoline-5-thione stabilizer precursors such as described in U.S. Pat. No. 3,893,859 of Burness et al, issued July 8, 1975.

When a stabilizer or stabilizer precursor is employed in an element according to the invention, a range of concentration of stabilizer or stabilizer precursor can be useful. An optimum concentration of stabilizer or stabilizer precursor will depend upon such factors as the particular element, processing conditions, particular stabilizer or stabilizer precursor, desired stability of the developed image, and the like. A typically useful concentration range of stabilizer or stabilizer precursor, when one is employed is within the range of about 0.001 to about 100 moles of stabilizer or stabilizer precursor per mole of photosensitive component in the element according to the invention. Preferably a concentration within the range of about 0.01 to about 10 moles of stabilizer or stabilizer precursor per mole of photosensitive component is used.

The described element according to the invention can contain a variety of colloids and polymers alone or in combination as vehicles, binding agents, and in various layers. Suitable materials can be hydrophobic or hydrophilic. It is necessary, however, that the colloid and polymers used in the element not adversely affect the charge sensitivity or ohmic resistivity of the described element of the invention. Accordingly, the selection of an optimum colloid and polymer, or combination of colloids or polymers, will depend upon such factors as the desired charge sensitivity, desired ohmic resistivity, particular polymer, desired image, particular processing conditions and the like. Suitable materials can be transparent or translucent and include both naturally-occurring substances such as proteins, for example, gelatin, gelatin derivatives, cellulose derivatives, polysaccharides, such as dextran, gum arabic and the like. Synthetic polymeric substances, however, are preferred due to their desired charge sensitivity properties and ohmic resistivity properties. Useful polymeric materials for this purpose include polyvinyl compounds, such as poly(vinyl pyrrolidone), acrylamide polymers, and dispersed vinyl compounds such as in latex form, particularly those which increase dimensional stability of the charge-sensitive element. Effective polymers include water insoluble polymers of alkylacrylates and methacrylates, acrylic acid, sulfoalkylacrylates, methacrylates, and those which have crosslinking sites which facilitate hardening or curing. Especially useful polymers are high molecular weight materials and resins which are compatible with the described tellurium (II) complexes in the described element according to the invention. These include, for example, poly(vinyl butyral), cellulose acetate butyrate, poly(methyl methacrylate), poly(vinyl pyrrolidone), ethyl cellulose, polystyrene, poly(vinyl chloride), poly(isobutylene), butadiene-styrene copolymers, vinyl chloride-vinyl acetate copolymers, copolymers of vinyl acetate, vinyl chloride and maleic acid, and poly(vinyl alcohol). Combinations of the described colloids and polymers can also be useful depending upon the described factors.

It is in some cases useful to employ what is described an an overcoat layer on an element according to the invention if the overcoat layer does not adversely affect the desired charge sensitivity and ohmic resistivity properties of the element according to the invention. Such an overcoat layer can reduce fingerprinting and abrasion marks before and after exposure and processing. The overcoat layer can be one or more of the described polymers. These materials must be compatible with other components of the described element according to the invention and must be able to tolerate the processing temperatures employed.

When the charge-sensitive recording material according to the invention is used with a photoconductor, selection of an appropriate polymeric binder should include consideration of the desired impedance match between the recording material and the photoconductor. It is essential, however, that the binder selected does not adversely affect the desired charge sensitivity or other properties of the charge-sensitive material.

The elements according to the invention can contain addenda which aid in providing a desired image. These addenda can include, for example, development modifiers that function as speed-increasing compounds, hardeners, plasticizers and lubricants, coating aids, brighteners, spectral sensitizing dyes, absorbing and filter dyes. These addenda are described, for example, in the *Product Licensing Index,* Volume 92, December 1971, publication 9232, pages 107–110 published by Industrial Opportunities Ltd., Homewell, Havant Hampshire, PO9 1EF, UK.

The charge-sensitive material according to the invention can comprise a wide variety of supports. Typical supports include cellulose ester film, poly(vinyl acetal) film, poly(ethylene terephthalate) film, polycarbonate film and polyester film supports as described in U.S. Pat. Nos. 3,634,089 of Hamb, issued Jan. 11, 1972 and U.S. Pat. 3,725,070 of Hamb et al, issued Apr. 3, 1973 and related films and resinous materials. Other supports are useful such as glass, paper, metal and the like which can withstand the processing temperatures employed and do not adversely affect the charge-sensitive properties and ohmic resistivity which is desired. Typically, a flexible support is employed.

If the described support is an insulator, the recording element according to the invention must also include an electrically conductive layer positioned between the support and the charge-sensitive layer.

The described layers of an element according to the invention can be coated on a suitable support by various coating procedures known in the photographic art including dip coating, airknife coating, curtain coating or extrusion coating using hoppers such as described in U.S. Pat. No. 2,681,294 of Beguin, issued June 14, 1954. If desired, two or more layers can be coated simultaneously such as described in U.S. Pat. No. 2,761,791 of Russell, issued Sept. 4, 1956 and British Pat. No. 837,095.

The various components of the charge-sensitive materials according to the invention can be prepared for coating by mixing the components with suitable solutions or mixtures including suitable organic solvent solutions depending on the particular charge-sensitive material and the components. The components can be added using various procedures known in the photographic art.

Especially useful charge-sensitive elements according to the invention can comprise an electrically conductive support having thereon a layer which has a thickness within the range of about 1 to 30 microns, typically within the range of about 2 to 15 microns. The optimum layer thickness of each of the described layers in a charge-sensitive element according to the invention will depend upon such factors as the particular ohmic resistivity desired, charge sensitivity, particular components of the layers, desired image, and the like.

A variety of photoconductors can be useful in an element according to the invention. Selection of an optimum photoconductor will depend upon such factors as the particular non-silver electrically activated recording layer, the charge sensitivity of the element, the ohmic resistivity desired, exposure means to be used, and the like. It is advantageous to select a photoconductor which has the property of being the most useful with the operative voltages to be used for imaging as well as the impedances of the recording layer as described. For example, it is preferable that the relative impedances of the recording layer and the photoconductor differ by no more than approximately $10^5$ ohms. The photoconductor can be either an organic photoconductor or an inorganic photoconductor. Combinations of photoconductors can be useful. The resistivity of the photoconductor can change rapidly in the operating voltage range which can be used according to the invention. Examples of useful photoconductors include PbO, CdS, Se and LnO. These photoconductors are described, for example, in Reithel U.S. Pat. No. 3,577,272; Reithel, Item No. 1120 in *Research Disclosure,* August 1973, published by Industrial Opportunities Ltd., Homewell, Havant Hampshire, P09 1EF, U.K.; "Electrography" by R. M. Schaffert (1975) and "Xerography and Related Processes," by Dessauer and Clark (1965) both published by Focal Press Ltd.

An especially useful photoconductor layer in an element according to the invention comprises a dispersion of lead oxide in an insulating binder, such as a binder comprising Lexan (a trademark of General Electric Company, U.S.A., representing a bisphenol A polycarbonate), polystyrene or poly(vinyl butyral).

A recording element according to the invention is especially useful wherein the photoconductor layer is X-ray sensitive and the conductivity of the photoconductor layer can be imagewise altered by imagewise exposing the photoconductive layer to X-ray radiation.

The desired resistivity characteristics of a material according to the invention can be obtained by separately measuring the current-voltage characteristic of each sample coating at room temperature using a mercury contact sample holder to make a mercury contact to the surface of the coating. To eliminate the possibility that a micro thickness surface air gap might effect the measured resistivity, exposures can be made with an evaporated metal (gold or aluminum) electrode on the surface of a charge-sensitive and photoconductor coating to be tested. The resistivity can be measured at various ambient temperatures. The data can be measured at a voltage of, for example, 400 volts, or $2\times10^5$ volts per centimeter, which is within the ohmic response range of the layer to be tested. It can be expected that the resistivity of the charge-sensitive layer will vary widely with temperature with the largest decrease in resistivity occurring at a particular temperature range above about 20° to 30° C. It can also be expected that the dielectric strength of the layer will vary with temperature. The selection of an optimum temperature accordingly can be determined based on the dielectric strength of the layer.

A variety of energy sources can be useful for imagewise exposre of a recording element as described. Selection of an optimum energy source for imagewise exposure will depend upon such factors as the sensitivity of the photoconductor layer, the particular image recording combination in the electrically activated recording layer, desired image, and the like. Useful energy sources for imagewise exposure include, for example, visible light, X-rays, lasers, electron beams, ultraviolet radiation, infrared radiation and gamma rays.

Spectral sensitizing dyes can be useful in the described elements according to the invention to confer additional sensitivity to the elements. Useful sensitizing dyes are described, for example, in the *Product Licensing Index,* Volume 92, December 1971, publication 9232, pages 107–110, paragraph XV published by Industrial Opportunities Ltd., Homewell, Havant Hampshire, P09 1EF, UK.

One useful embodiment of the invention is a non-silver, charge-sensitive recording composite element having an ohmic resistivity of at least about $1\times10^{10}$ ohm-cm comprising, in sequence, a support having thereon (a) a nickel, electrical conducting layer, (b) an organic photoconductor layer, (c) a non-silver electrically activated recording layer comprising an image-forming combination of (i) a tellurium (II) xanthate complex, with (ii) a sulfonamidophenol reducing agent, and a polymeric binder, and (d) a chromium composition, electrical conducting layer.

A non-silver charge-sensitive recording composite element according to the invention can contain more than one electrically activated recording layer, if desired. According to this embodiment, for example, a non-silver charge-sensitive recording composite element according to the invention having an ohmic resistivity of at least $1\times10^{10}$ ohms-cm can comprise, in sequence, a support having thereon (a) a first electrical conducting layer, (b) a first photoconductor layer, (c) a first non-silver, electrically activated recording layer comprising a first image-forming combination of (i) a tellurium (II) coordination complex represented by the formula: YTeY' wherein Y and Y' are independently bidentate, sulfur containing, univalent anions represented by the formula:

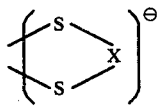

wherein X represents the atoms necessary to complete a dithiocarbamate, xanthate, thioxanthate, dithioacid, dithiophosphinate, difluorodithiophosphinate, dithiophosphate or dithiocarbimate radical, as described, with (ii) a reducing agent, and a binder, and (d) a second electrical conducting layer, (e) a further support, if desired, (f) a third electrical conducting layer, (g) a second, electrical activated recording layer, and (h) a second photoconductor layer. An especially useful recording composite element, as described, can comprise a tellurium (II) coordination complex represented by the formula, as described, wherein the anion is a xanthate radical.

A variety of processing means can be useful for producing a developed tellurium image in a charge-sensitive recording element according to the invention. Typically, a dry electrically activated recording process for producing a developed tellurium image in a charge-sensitive recording element having an ohmic resistivity of at least about $1\times10^{10}$ ohm-cm and containing at least one electrically activated recording, image-forming combination of (i) a tellurium (II) coordination complex represented by the formula as described above, with (ii) a reducing agent, also as described, comprises the steps of: (a) applying an electric potential imagewise to the described recording element of a magnitude and for a time sufficient to produce in the image areas a charge density within the range of about 1 microcoulomb/cm$^2$ to about 1 millicouloumb/cm$^2$, wherein the charge density forms a developable latent image in the recording element; and (b) heating the recording element substantially uniformly at a temperature and for a time sufficient to develop the latent image.

An imagewise current flow is provided through the described electrically activated recording layer. Although a particular technique to produce an imagewise current flow has been described for use in a variety of recording apparatus, the especially useful techniques are those which include use of a photoconductive layer as an image to current converter. The imagewise current flow can be provided, however, by contacting the recording element with a suitable electrostatically charged means such as an electrostatically charged stencil and scanning the recording element with a beam of electrons.

Heating the recording element after latent image formation can be carried out by techniques and with means known in the photothermographic art, for example, by passing the imagewise exposed recording element over a heated platen or through heated rolls, by heating the element with microwaves, with dielectric heating means, and the like. A visible image can be developed in the described exposed material within a short time by the described uniform heating step. An image having a maximum reflection density of at least 1.8 and typically at least 1.5 can be provided according to the invention. For example, the element can be uniformly heated to a temperature within the range of about 100° C. to about 180° C. until a desired image is developed, typically within about 1 to about 90 seconds. The imagewise exposed material according to the invention is preferably heated to a temperature within the range of about 120° C. to about 150° C. until the desired image is developed.

Another embodiment of the invention is a dry, non-silver, electrically activated recording process for producing a developed tellurium image in a charge-sensitive recording composite element having an ohmic resistivity of at least about $1\times10^{10}$ ohm-cm comprising, in sequence, a support having thereon (a) a first electrical conducting layer, (b) a photoconductor layer, (c) an electrically activated recording layer comprising an image-forming combination of (i) a tellurium (II) coordination complex represented by the formula, as described, with (ii) a reducing agent, also as described, and a binder, and (d) a second electrical conducting layer, comprising (A) imagewise altering the conductivity of the described photoconductor layer in accord with an image (I) to be recorded, and (B) applying an electric potential across the described photoconductive and recording layers of a magnitude and for a time sufficient to produce a developable latent image in the recording layer corresponding to the image (I); and then (C) heating the recording layer substantially uniformly at a temperature and for a time sufficient to develop the latent image. The development step is typically carried out at a temperature within the range of about 80° C. to about 200° C., such as within the range of about 100° C. to about 180° C.

An especially useful process according to this embodiment is a dry electrically activated recording process for producing a developed tellurium image in a charge-sensitive recording element having an ohmic resistivity of at least about $1\times10^{10}$ ohm-cm and comprising, in sequence, a support having thereon (a) a nickel electrical conducting layer, (b) an organic photoconductor layer, (c) a non-silver, electrically activated recording layer comprising an image-forming combination of (i) a tellurium (II) xanthate complex, as described, with (ii) a sulfonamidophenol reducing agent, and a polymeric binder, and (d) a chromium composition, electrical conducting layer, comprising (A) imagewise altering the conductivity of the described photoconductor layer in accordance with an image (I) to be recorded, and (B) applying an electric potential across the described photoconductive and recording layers of a magnitude and for a time sufficient to produce a developable latent image in the recording layer corresponding to the image (I), and (C) heating the recording layer substantially uniformly at a temperature and for a time sufficient to develop the developable latent image. The described element after exposure is heated in (C) to a temperature typically within the range of about 100° C.

to about 180° C. for a time within the range of about 1 to about 120 seconds until the latent image is developed.

The described process can comprise a potential applying step which includes disposing one surface of the described recording element in electrical connection with an electrically conductive member and contacting portions of the opposite surface of the described recording element with an electrode and an imagewise pattern while maintaining an electric field strength of about $1\times10^5$ volts per centimeter between the electrode and the described conductive member.

Another embodiment of the invention involves imagewise altering the conductivity of a photoconductive layer, as described, and then placing the layer in contact with an electrically activated recording layer, also as described, with subsequent application of an electrical potential across the photoconductive and recording layers at the desired magnitude and for a time sufficient to provide a developable latent image. This embodiment, for example, includes a dry electrically activated recording process for producing a developed tellurium image in an electrically activated recording element comprising, in sequence, the steps of (a) imagewise altering the conductivity of a photoconductive layer (I) in accordance with an image that is to be recorded, (b) positioning the imagewise altered photoconductive layer (I) from (a) adjacent an electrically activated recording layer (II) of the described recording element comprising at least one electrically activated recording, image-forming combination of (i) a tellurium (II) coordination complex as described, with (ii) a reducing agent, and a binder wherein the recording layer has an ohmic resistivity of at least about $1\times10^{10}$ ohm-cm, (c) applying an electric potential across the described photoconductive and recording layers of a magnitude and for a sufficient period of time to produce in the areas of the recording layer corresponding to the imagewise altered portions of the photoconductive layer a charge density within the range of about 1 microcouloumb/cm$^2$ to about 1 millicouloumb/cm$^2$, the charge density forming in said areas a developable latent image, and (d) uniformly heating the recording element at a temperature and for a time sufficient to develop the latent image. The described process can be useful for formation of more than one copy of the desired image by the added steps of (e) positioning the described imagewise altered photoconductive layer adjacent a second electrically activated recording layer having an ohmic resistivity of at least about $1\times10^{10}$ ohm-cm and containing at least one reducible metal salt; (f) applying an electrical potential across the photoconductive and recording layers of a magnitude and for a time sufficient to produce in the areas of the latent image of the photoconductive layer a charge density within the range of about 1 microcouloumb/cm$^2$ to about 1 millicouloumb/cm$^2$, the charge density forming a developable latent image; and (g) uniformly heating the recording element at a temperature and for a time sufficient to develop the latent image. This enables the formation of more than one copy of the desired image.

Another process embodiment according to the invention is a dry electrically activated recording process for producing a developed tellurium image in a charge-sensitive recording element having an ohmic resistivity of at least about $1\times10^{10}$ ohm-cm and comprising an electrically activated recording combination comprising (i) a tellurium (II) coordination complex represented by the formula, as described, with (ii) a reducing agent, also as described, comprising, in sequence, the steps: (a) positioning the recording element in face-to-face contact with a suitable photoconductive element; (b) exposing the photoconductive element to an imagewise pattern of actinic radiation while simultaneously applying an electrical potential having a field strength of at least about $1\times10^5$ volts per centimeter across the photoconductive and recording element for a time sufficient to provide a developable latent image in the areas of the recording element corresponding to the exposed areas of the photoconductive layer; and (c) uniformly heating the recording element at a temperature and for a time sufficient to develop the latent image. In this process it is especially useful to have the impedance of the recording element differ from the impedance of the photoconductive element by no more than about $10^5$ ohm-cm when the latent image-forming electrical potential is applied across the photoconductive and recording layers. It is also useful in this process to have the latent image-forming electric potential provide a charge density within the range of about 1 microcouloumb/cm$^2$ to about 1 millicouloumb/cm$^2$ in the areas of the recording element corresponding to the exposed areas of the photoconductive element. This process is typically useful wherein the photoconductive element is X-ray sensitive and the conductivity of the element is imagewise altered by exposing the photoconductive element to X-ray radiation in accordance with the image to be recorded.

The image recording process according to the invention can also be carried out using a step in which a conductivity pattern is formed on a dielectric material. A process according to this embodiment comprises in sequence the steps of (a) forming a conductivity pattern on a dielectric material; (b) sequentially positioning the dielectric material containing the conductivity pattern in face-to-face contact with a plurality of charge-sensitive recording materials having an ohmic resistivity of at least $1\times10^{10}$ ohm-cm and containing at least one electrically activated recording material comprising (i) a tellurium (II) coordination complex represented by the formula, as described, with (ii) a reducing agent, also as described, in a binder and establishing a potential difference across the dielectric and recording materials of a magnitude and for a time sufficient to produce a charge density within the range of about 1 microcouloumb/cm$^2$ to about 1 millicouloumb/cm$^2$ in the area of each recording material corresponding to the described conductivity pattern, wherein the charge density is sufficient to form a developable latent image in the described recording material; and (c) uniformly heating the recording materials at a temperature and for a time sufficient to develop the latent image.

Another process embodiment of the invention can comprise using the modulation of a corona ion current flow in the process to provide a desired developable image. This embodiment can comprise, for example, a dry electrically activated recording process for producing a developed tellurium image in a charge-sensitive recording element having an ohmic resistivity of at least $1\times10^{10}$ ohm-cm and containing at least one electrically activated recording material comprising (i) a tellurium (II) coordination complex represented by the formula, as described, with (ii) a reducing agent, as described, and a binder, comprising, in sequence, the steps of: (a) positioning the recording element on a electrically conducting backing member; (b) modulating a corona ion current flow to the recording element by an electrostatic field established imagewise between (1) an image grid comprising an electroconductive core sequentially connectable to sources of different potential relative to the backing member and covered with a coating of a photoconductive insulating material and (2) a control grid that is electrically conductive and sequentially connectable to sources of different potential relative to the backing member, the current flow being of a magnitude sufficient to produce a charge density within the range of about 1 microcouloumb/cm$^2$ to about 1 millicouloumb/cm$^2$ imagewise in the described recording element, which charge density forms a developable latent image in the electrically activated recording material; and (c) uniformly heating the recording element at a temperature and for a time sufficient to develop the latent image.

While the exact mechanism of image formation upon heating is not fully understood, it is believed that the imagewise exposure to charge provides nuclei in the image areas. It is believed that the nuclei formed in the image areas increase the reaction rate and act as catalysts for the reaction between the described tellurium complex and reducing agent. It is believed that the nuclei enable a form of amplification which would not otherwise be possible. The described tellurium complex and reducing agent must be in a location with respect to each other which enables the nuclei to provide the desired catalytic effect. The described tellurium complex and reducing agent are in reactive association in the electrically activated recording layer. The term "in reactive assocation" is intended to mean that the nuclei resulting from the imagewise exposure are in a location with respect to the described tellurium complex and reducing agent which enables this desired catalytic activity, desired lower processing temperature and provides a more useful developed image.

Figure 2:
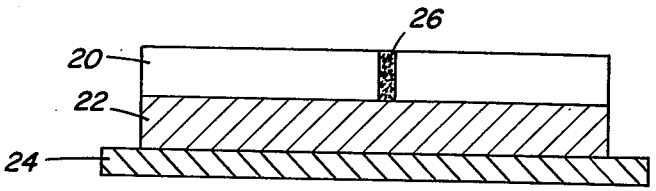

Referring to the drawings, in particular to FIGS. 1 and 2, these illustrate embodiments of the process of the invention depicted schematically. According to the embodiment illustrated in FIGS. 1 and 2, a charge-sensitive, recording layer 10 is placed upon a grounded electrically conductive backing or support 12. A current is selectively applied to the recording layer 10 by the point of a metal stylus 14 which is raised to a sufficiently high voltage relative to the support 12 by a voltage source 16, and brought into moving contact with the exposed surface of the recording layer 10. Upon contacting the recording layer 10 with the stylus 14, a current flows in the areas of the recording layer contacted by the stylus and forms a developable latent image, that is a pattern of nuclei sites, in the pattern desired. The charge density produced by the stylus in the contacted areas of the recording layer need not be sufficient to produce a visible image in the recording layer 10; however, the charge density is sufficient to produce a latent image in the recording layer in those areas contacted by the stylus. Although a particular technique to produce an imagewise current flow through the recording layer 10 has been described, techniques generally known in the art of recording can be used and are intended to be encompassed by the description. The area of the recording layer 10 designated at 18 is intended to be illustrative of an area of nuclei sites formed upon contact of the stylus 14 with the recording layer 10. Other techniques for producing a nuclei pattern include, for example, contacting the recording layer 10 with an electrostatically charged stencil or scanning the layer 10 with a beam of electrons in an image pattern.

FIG. 2 illustrates development of the latent image formed in the recording element in FIG. 1 by, for example, moving the element from FIG. 1 into contact with a heated metal platen 24. The heat from platen 24 passes through the support 22 to the layer 20 containing the latent image to cause the desired reaction in the latent image area. The reaction in the latent image area causes development to produce a visible image 26 in the recording layer 20. Upon development, the recording element is removed from the heated platen 24. No processing solutions or baths are required in this heat development step as illustrated in FIG. 2.

Figure 3:
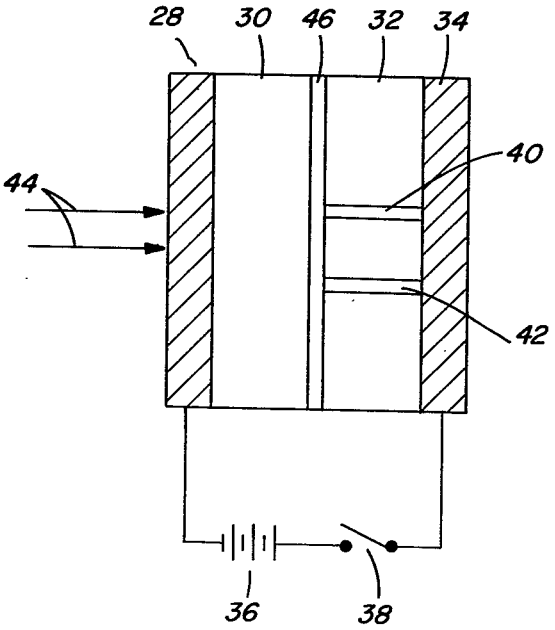
FIGS. 3 and 4 illustrate schematically an electrophotographic process embodying the described invention.
Figure 4:
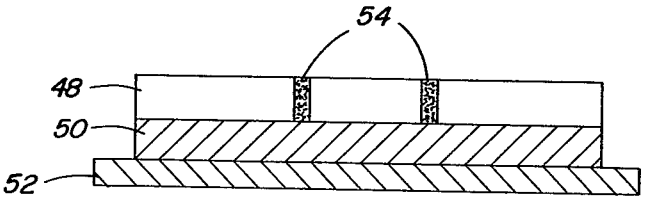

Another illustrative embodiment of the invention is schematically shown in FIGS. 3 and 4. In this embodiment, in FIG. 3, the developable nuclei sites 40 and 42, that is the latent image, are formed by sandwiching a charge-sensitive, resistive recording layer 32 and an image to current converter 30, preferably a photoconductive layer, between a pair of electrically conductive layers 28 and 34, respectively. A high potential electric field is established across the photoconductive and recording layers by connecting the conductive layers 28 and 34 by connecting means 36. The electric field across the layers is controlled by switch 38. Latent image formation at latent image sites 40 and 42 is caused by imagewise exposing the photoconductive layer 30 through the transparent conductor 28 to exposure means 44, typically actinic radiation. The exposure selectively increases the conductivity of the photoconductive layer in those regions exposed to actinic radiation. When switch 38 is closed, thereby establishing an electric potential across the layers, an imagewise current flow is produced through the recording layer 32. The current flow occurs only in those regions of the recording layer 32 in position with the exposed portions of the photoconductive layer 30. It is especially useful in this embodiment to provide a small air gap 46 between layers 30 and 32. This provides for an improved image in the recording layer 32. After a charge density of less than 1 millicouloumb/cm$^2$, preferably about 1 microcouloumb/cm$^2$, has been produced in the current exposed portions of the recording layer 32, switch 38 is opened, thereby disrupting the current flow. The described technique for the application of voltage across the photoconductive and recording layers is illustrative. A variety of techniques known in the recording art can be useful and are intended to be included in this description. For example, a grid controlled corona discharge means can be substituted for the voltage source and conducting layer 28 of the recording element.

To develop the latent image sites 40 and 42, the recording element is moved away from the photoconductive layer. Connecting means 36 is also disconnected. The recording element illustrated in FIG. 4 is then contacted with a heated platen 52, as illustrated in FIG. 4. The heat from the platen 52 passes through support 50 to the layer 48 to provide a developed image 54. The heating is preferably carried out substantially uniformly by merely positioning the recording element in heat transfer relationship with the heated platen 52. After the development of the latent image sites, the recording element is removed from the platen.

The resistivity of the recording layers useful according to the invention may be effected by exposure history, the direction of the applied field, and when sandwiched with a photoconductor, by air gap affects and photoconductor affects. The number of variables affecting the resistivity of the recording layers useful according to the invention coupled with their non-ohmic behavior at higher applied fields can influence the choice of an optimum recording material and imaging means. The resistivity values as described herein for particular charge-sensitive recording elements are therefore values measured under temperature and voltage conditions which produce ohmic behavior.

If desired, the recording element and means according to the invention can be readily modified to provide a continuous image recording operation. This can be carried out using desired control circuitry and continuous transport apparatus.

In the embodiments illustrated which use an air gap between the photoconductor and image recording layers, the air gap distances are typically controlled by the roughness of the surfaces of the photoconductor layer as well as the image recording layer. Although the air gap need not be uniform, it can be, for example, within the range of about 1 to about 5 microns thickness. For example, the distance shown in FIG. 3 between photoconductor layer 30 and recording layer 32 can be within the range of about 1 to about 5 microns as illustrated by air gap 46.

The following examples are included for a further understanding of the invention.

EXAMPLE 1

Electrically activated recording according to the invention

A charge-sensitive recording element according to the invention is prepared by coating the following tellurium (II) coordination complex composition on a support which is electrically conductive. The support consists of a poly(ethylene terephthalate) film containing a layer of an electrically conductive composition consisting of chromium and silica known under the trade name of Cermet.

| | |
|---|---|
| solution of tellurium di(butylxanthate) (120 mg in a 2% by weight solution of poly(vinyl butyral) in 1:1 parts by volume acetone/toluene) | 7.5 ml |
| solution of 1-phenyl-3-pyrazolidone (10% by weight in 1:1:1 parts by volume acetone-toluene-dimethylformamide) | 1.5 ml |

The poly(vinyl butyral) functions as a binder in the image recording layer.

The composition containing the tellurium (II) coordination complex is coated at a 4 mil wet thickness on the described conductive support to provide about 70 mg of tellurium per square foot (equal to about 750 mg of tellurium per square meter).

A light-sensitive element is prepared by coating an aggregate-type organic photoconductor as described in U.S. Pat. No. 3,615,414 of Light, issued Oct. 26, 1971 on a poly(ethylene terephthalate) film support which was coated with nickel to provide an electrically conductive layer. The photoconductor layer was 12 microns thick. The light-sensitive element and the element containing the tellurium (II) complex were placed in face-to-face contact. The photoconductor was imagewise exposed to light with simultaneous application of a voltage of 1.8 kilovolts applied across the composite photoconductor and image recording material. A positive polarity was applied to the photoconductor. The imagewise exposures were for a sufficient time to provide a developable latent image in the image recording layer, typically about 120 seconds at 55 foot candles of illumination using gold fluorescent illumination having a wavelength of about 500 to 700 nanometers. After imagewise exposure, the two elements were separated and the recording layer containing the latent image was uniformly heated by contacting it with a heated platen for 7 seconds at 160° C.

A developed image was produced having a maximum density of 0.5 and a minimum density of 0.1. The resulting developed image was stable to ambient conditions of light and temperature.

EXAMPLES 2–8

Charge-sensitive recording elements according to the invention

Charge-sensitive recording layers were prepared by dissolving 135 mg of the tellurium complex designated in following Table I and 150 mg of the reducing agent, also as designated in following Table I, in 9 ml of a 2% by weight solution of poly(vinyl butyral) in 1:1 parts by volume acetone-toluene which contained 0.2 grams of colloidal silica (Cab-O-Sil, which is a trademark of the Cabot Corporation, U.S.A.). The described solutions were coated at a 4 mil wet coating thickness on a conductive support consisting of cermet coated on poly(ethylene terephthalate) film support. This conductive support is as described in Example 1. Each recording layer was placed in face-to-face contact with a photoconductive layer as described in Example 1 and imagewise exposed in the same manner as that described in Example 1. A charge exposure of about 1,000 microcouloumbs/cm$^2$ was used in each instance. Examples 7 and 8 relate to tellurium materials that are not within the described Te(II) complexes according to the invention but are included for comparative purposes.

Table I

| Example No. | Te-Compound | Reducing Agent | Applied Voltage (Polarity) | Processing Conditions (°C., sec.) | Density, (Image, Fog |
|---|---|---|---|---|---|
| 2 | $Te(S_2COC_3H_7)_2$ | Benzenesulfonamidophenol | (+)2500 | 150, 2 | 1.8<br>0.2 |
| 3 | same | same | (−)2500 | 150, 2 | 1.8<br>0.2 |
| 4 | $Te(S_2CO\text{-}i\text{-}C_3H_7)_2$ | 2,6-dichlorobenzenesulfonamidophenol | (+)2300 | 110, 3 | 0.94<br>0.28 |
| 5 | same | same | (−)2300 | 110, 3 | 1.41<br>0.28 |
| 6 | $Te[S_2CN(C_2H_5)_2]_2$ | same | (+)2300 | 110, 10 | 0.36<br>0.26 |
| 7 | $Na_2Te(S_2O_3)_2 \cdot 2H_2O$ | same | (+)2300 | 110, 10 | 0.28<br>0.16 |
| 8 | same | same | (−)2300 | 110, 10 | 0.27 |

Table I-continued

| Example No. | Te-Compound | Reducing Agent | Applied Voltage (Polarity) | Processing Conditions (°C., sec.) | Density, (Image, Fog |
|---|---|---|---|---|---|
| | | | | | 0.16 |

EXAMPLE 9

Add-on property for an electrically activated recording element according to the invention The electrically activated recording layer containing the tellurium (II) complex described in Example 4 was prepared and then given an imagewise charge exposure of 500 microcouloumbs/cm$^2$. This provided a developable latent image in the recording layer. The latent image was developed by uniformly heating the recording layer at 110° C. for 3 seconds to provide a black negative developed image. A second imagewise exposure was given to the recording layer in a similar manner and heat development of this imagewise exposed element was carried out under similar conditions to provide an additional developed different image in the originally undeveloped area of the recording element.

EXAMPLE 10

A colloidal suspension of silica was prepared by dispersing 3.3 grams of colloidal silica in 100 ml of a 5% by weight solution of poly(styrene) in a solvent consisting of 7:3 parts by volume dichloromethane-1,1,2-trichloroethane. Then 0.5 ml of a 20% by weight solution of a polysiloxane leveling agent (Silicone AF-70, which is a trade name of the General Electric Company, U.S.A.) in acetone-toluene was added to the colloidal silica-poly(styrene) dispersion. The tellurium (II) coordination complex formulation was prepared by coating the following solution at a 2 mil wet coating thickness on a conductive support (Cermet on poly(ethylene terephthalate) film support) at 40° C. followed by drying for 5 minutes at 50° C.:

| | | |
|---|---|---|
| dispersion of tellurium bis(isopropylxanthate) (dissolved in 7.5 ml of the described colloidal silica-poly(styrene) dispersion) | 105 | mg |
| sulfonamidophenol reducing agent solution (157 mg of 2,6-dichloro-4-benzenesulfonamidophenol with 800 mg of benzenesulfonamidophenol dissolved in 10 ml of 1:1 parts by volume acetone-toluene) | 0.3 | ml |

The resulting recording element was placed in face-to-face contact with a photoconductor layer which comprised a coating of an aggregate type organic photoconductor as described on a conductive support which consisted of nickel coated poly(ethylene terephthalate) film. The photoconductive layer and image recording layer were then imagewise exposed by exposing the photoconductor layer to visible light imagewise with simultaneous application of a voltage of 0.5 to 5.5 kilovolts across the composite element to generate an imagewise current flow within the range of $10^{-3}$ to $10^{-8}$ couloumbs/cm$^2$ in the image-recording layer. This provided a developable latent image in the image-recording layer containing the tellurium (II) coordination complex.

The resulting developable latent image was developed by contacting the recording layer with a heating means at a temperature within the range of 110° C. to 160° C. for about 1 to about 10 seconds to develop the image. A visible negative image was developed.

EXAMPLE 11

Positive working electrically activated recording element containing a tellurium (II) coordination complex A positive working electrically activated recording material was formulated by the procedure described in Example 10 with a slight modification of the coating preparation. That is, the colloidal silica-poly(styrene) dispersion was ball milled for 72 hours. The heat development step was also carried out in 3 successive heating steps 10 seconds apart. That is, the imagewise exposed recording element was heated for 10 seconds at 120° C., then 20 seconds at 150° C. and finally for 20 seconds at 150° C. The positive working formulation utilized poly(vinyl butyral) as a binder instead of poly(styrene).

The positive working electrically activated recording element was prepared as follows: A colloidal suspension of silica was prepared by ball milling for 72 hours, 3.3 g of colloidal silica (Cab-O-Sil) in 100 ml of a 5% by weight solution of poly(vinyl butyral) in 7:3 parts by volume dichloromethane-1,1,2-trichloroethane. Subsequently, 0.5 ml of a 20% by weight solution of a polysiloxane leveling agent (Silicone AF-70, available from the General Electric Company, U.S.A.) in acetone-toluene was added to the colloidal silica-poly(vinyl butyral) dispersion. The electrically activated recording formulation was prepared by coating the following composition at a 2 mil wet coating thickness on a conductive support at 40° C. and then permitting the coating to dry for 5 minutes at 50° C. The conductive support consisted of a poly(ethylene terephthalate) film coated with Cermet.

| | | |
|---|---|---|
| solution of tellurium bis(isopropylxanthate) (dissolved in 7.5 ml of the described colloidal siclica-poly (styrene) dispersion) | 105 | mg |
| sulfonamidophenol reducing agent solution (157 mg of 2,6-dichloro-4-benzenesulfonamdiophenol with 800 mg of benzenesulfonamidophenol dissolved in 10 ml of 1:1 parts by volume acetone-toluene) | 0.3 | ml |

The resulting electrically activated recording element was placed in face-to-face contact with a photoconductor layer as described in the preceding example and imagewise exposed as described to provide a developable latent image. The positive image was developed by the three successive heating steps as described. The positive developed image had a maximum density of 1.2 with a minimum density of 0.35.

EXAMPLE 12

Electrically activated recording with tellurium (II) coordination complex and vacuum deposited silver nuclei Silver nuclei were deposited on a conductive support (Cermet coated on poly(ethylene terephthalate) film support). The silver nuclei were coated at an average coverage of $7.2\times10^{-8}$ grams/cm$^2$. Imagewise light exposure was made through a silver test negative employing a 12 micron thick layer of aggregate-type organic photoconductor on nickel coated poly(ethylene terephthalate) as the light-sensitive element. Imagewise light exposures were made for 200 seconds using a 55 foot candle fluorescent light source. A voltage of 1.0 kilovolts was applied to the photoconductor-image recording layer composite element during the imagewise exposure. A positive polarity was applied to the organic photoconductor. The imagewise exposed photoconductor layer was then laminated with the image recording layer containing the tellurium (II) coordination complex described below. The resulting developable latent image in the image-recording layer was developed by uniformly heating the recording layer for 10 seconds at 175° C. A developed, direct-positive image was produced having a neutral image tone. The developed image had a maximum density of 1.4 and a minimum density of 0.4.

The image recording element, as described, was prepared by coating at a 9 mil wet coating thickness the following solution on a resin coated paper support:

solution of $Te(S_2CN(C_2H_5)_2)_2$ (40 mg dissolved in 10 ml of a 2% by weight acetone-toluene (1:1 parts by volume) solution of poly(vinyl butyral)).

The tellurium complex containing composition was added to a solution (a) of 2 ml of a 10% by weight solution of a reducing agent which is 2-hydroxy-5-methyl-3-piperidino-2-cyclopentanone in acetone-toluene-dimethylformamide (45:45:10 parts by volume).

Typically, the maximum reflection density for a developed image using an especially useful tellurium (II) coordination complex formulation, as described, is in the 1.40 to 1.50 range. The minimum reflection density is typically within the range of about 0.3 to about 0.4.

In the above examples a preferred exposure range is within the range of about $10^{-3}$ to about $10^{-9}$ couloumbs/cm$^2$.

The concentration range of polymeric binder in the above examples can be within the range of about $2\times10^2$ to about $3\times10^3$ mg/ft$^2$ (equivalent to about $2\times10^3$ to about $3\times10^4$ mg/m$^2$) with an especially useful range being within the range of about 100 to about 2,000 mg/ft$^2$ (corresponding to about $10^3$ to about $2\times10^4$ mg/m$^2$). Especially useful binders in the above examples are poly(styrene) for negative-working electrically activated recording elements and poly(vinyl butyral) for positive-working electrically recording materials. In the above examples, an aggregate type organic photoconductor is preferred for imagewise exposure to light with a photoconductor consisting essentially of tetragonal lead oxide for X-ray exposure purposes.

The above examples provide improved imaging efficiency compared to silver formulations. Silver formulations also require a relatively high chemical load in that the silver formulations typically necessary to provide similar image density require about 330 mg of silver in the form of silver behenate/ft$^2$ (corresponding to 3500 mg of silver behenate/m$^2$) with 170 mg of reducing agent per ft$^2$ (corresponding to 1800 mg of reducing agent per m$^2$). In contrast, a typical electrically activated recording element, according to one of the above examples, requires only about 60 mg of the described tellurium (II) coordination complex per ft$^2$ (corresponding to about 650 mg of tellurium complex per m$^2$) and 18 mg of described organic reducing agent per ft$^2$ (corresponding to about 190 mg of organic reducing agent per m$^2$).

The invention has been described in detail with particular reference to preferred embodiments thereof, but it will be understood that variations and modifications can be effected within the spirit and scope of the invention.

What is claimed is:

1. A non-silver, charge-sensitive recording composite element having an ohmic resistivity of at least about $1\times10^{10}$ ohm-cm comprising, in sequence, a support having thereon (a) a first electrical conducting layer, (b) a photoconductor layer, (c) a non-silver, electrically activated recording layer comprising an image-forming combination of (i) a Te(II) coordination complex represented by the formula: YTeY′ wherein Y and Y′ are independently bidentate, sulfur containing, univalent anions represented by the formula:

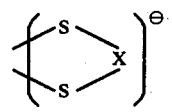

wherein X represents the atoms necessary to complete a dithiocarbamate, xanthate, thioxanthate, dithioacid, dithiophosphinate, difluorodithiophosphinate, dithiophosphate or dithiocarbimate radical, with (ii) a reducing agent, and a binder, and (d) a second electrical conducting layer.

2. A non-silver, charge-sensitive recording composite element as in claim 1 wherein said Te(II) coordination complex is represented by the formula:

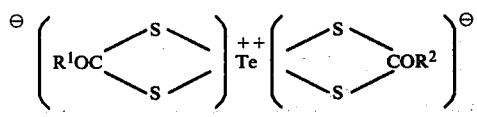

wherein $R^1$ and $R^2$ are individually alkyl containing 1 to 10 carbon atoms or aryl containing 6 to 12 carbon atoms.

3. A non-silver, charge-sensitive recording composite as in claim 1 wherein said Te(II) complex is selected from the group consisting of $Te(S_2COC_2H_5)_2$,
$Te(S_2CO\text{-}i\text{-}C_3H_7)_2$,
$Te(S_2COC_4H_9)_2$,
$Te(S_2COC_{10}H_{21})_2$ and
$Te(S_2CN(C_2H_5)_2)_2$.

4. A non-silver, charge-sensitive recording composite element as in claim 1 wherein said reducing agent is selected from the group consisting of 3-pyrazolidone, phenolic, reductone and sulfonamidophenol reducing agents and combinations thereof.

5. A non-silver, charge-sensitive recording composite element as in claim 1 wherein said reducing agent is p-benzenesulfonamidophenol or 2,6-dichlorobenzenesulfonamidophenol.

6. A non-silver, charge-sensitive recording composite element as in claim 1 wherein said binder is poly(vinyl butyral).

7. A recording element as in claim 1 wherein said photoconductor layer comprises a dispersion of lead oxide in an insulating binder.

8. A recording element as in claim 1 wherein said photoconductor layer is X-ray sensitive and the conductivity of said photoconductor layer can be imagewise altered by imagewise exposing said photoconductive layer to X-ray radiation.

9. A non-silver, charge-sensitive recording composite element as in claim 1 comprising about $10^{-5}$ to about $10^{-2}$ moles of said Te(II) complex per square meter of support.

10. A non-silver, charge-sensitive recording composite element as in claim 1 also comprising in said recording layer a reducible metal salt selected from the group consisting of salts of lead, nickel, and copper and combinations thereof.

11. A non-silver, charge-sensitive recording composite element as in claim 1 also comprising a concentration of colloidal silica in said recording layer which produces increased density in a developed image upon imagewise exposure and heating said recording layer.

12. A non-silver, charge-sensitive recording composite element having an ohmic resistivity of at least about $1\times10^{10}$ ohm-cm comprising, in sequence, a support having thereon (a) a nickel, electrical conducting layer,
(b) an organic photoconductor layer,
(c) a non-silver, electrically activated recording layer comprising an image-forming combination of
  (i) a Te(II) xanthate complex, with
  (ii) a sulfonamidophenol reducing agent, and a polymeric binder, and
(d) a chromium composition, electrical conducting layer.

13. A non-silver, charge-sensitive recording composite element as in claim 12 also comprising a concentration of colloidal silica in said recording layer which produces increased density in a developed image upon imagewise exposure and heating said recording layer.

14. A non-silver, charge-sensitive recording composite element having an ohmic resistivity of at least $1\times10^{10}$ ohm-cm comprising, in sequence, a support having thereon (a) a first electrical conducting layer,
(b) a first photoconductor layer,
(c) a first, non-silver, electrically activated recording layer comprising a first image-forming combination of
  (i) a Te(II) coordination complex represented by the formula: YTeY′ wherein Y and Y′ are independently bidentate, sulfur containing, univalent anions represented by the formula:

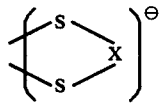

wherein X represents the atoms necessary to complete a dithiocarbamate, xanthate, thioxanthate, dithioacid, dithiophosphinate, difluorodithiophosphinate, dithiophosphate or dithiocarbimate radical, with
  (ii) a reducing agent, and a binder, and
(d) a second electrical conducting layer,
(e) a support,
(f) a third electrical conducting layer,
(g) a second, electrically activated recording layer, and
(h) a second photoconductor layer.

15. A non-silver, charge-sensitive recording composite element as in claim 14 wherein said Te(II) coordination complex is represented by the formula:

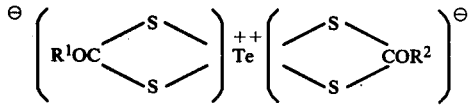

wherein $R^1$ and $R^2$ are individually alkyl containing 1 to 10 carbon atoms or aryl containing 6 to 12 carbon atoms.

* * * * *

UNITED STATES PATENT AND TRADEMARK OFFICE

CERTIFICATE OF CORRECTION

PATENT NO. : 4,155,761

DATED : May 22, 1979

INVENTOR(S) : Mark Lelental and Henry J. Gysling

It is certified that error appears in the above-identified patent and that said Letters Patent are hereby corrected as shown below:

Column 7, line 9, "insulated" should read ---insulating---.

Column 11, line 25, "agent" should read ---agents---; line 49, "Collodial" should read ---Colloidal---.

Column 12, line 43, "photograhic" should read ---photographic---; line 57, after "instances" delete "of".

Column 16, line 40, "exposre" should read ---exposure---.

Column 21, line 30, "assocation" should read ---association---.

Column 24, Table I, last column, a ")" should be inserted after the word "Fog".

Column 26, Table I, last column, a ")" should be inserted after the word "Fog"; line 56, "4-benzenesulfonamdiophenol" should read --- 4-benzenesulfonamidophenol ---.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*